US009158226B1

(12) United States Patent
Anno et al.

(10) Patent No.: US 9,158,226 B1
(45) Date of Patent: Oct. 13, 2015

(54) IMAGE FORMING APPARATUS, ELECTROSTATIC CHARGE IMAGE DEVELOPING CARRIER SET, AND PROCESS CARTRIDGE SET

(71) Applicant: FUJI XEROX CO., LTD., Tokyo (JP)

(72) Inventors: Shintaro Anno, Kanagawa (JP); Fusako Kiyono, Kanagawa (JP); Emi Matsushita, Kanagawa (JP); Hiroki Ohmori, Kanagawa (JP); Shuji Sato, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/605,174

(22) Filed: Jan. 26, 2015

(30) Foreign Application Priority Data

Sep. 2, 2014 (JP) ..... 2014-178200

(51) Int. Cl.
*G03G 15/01* (2006.01)
*G03G 15/08* (2006.01)
*G03G 21/18* (2006.01)

(52) U.S. Cl.
CPC ..... *G03G 15/0808* (2013.01); *G03G 21/1803* (2013.01)

(58) Field of Classification Search
USPC ..... 399/107, 110, 111, 119, 120, 222, 223, 399/258, 259; 430/108.4, 111.1, 111.35, 430/111.41
See application file for complete search history.

(56) References Cited

U.S. PATENT DOCUMENTS

| | | | | |
|---|---|---|---|---|
| 7,079,795 | B2 * | 7/2006 | Hibino | 399/267 |
| 2005/0196694 | A1 * | 9/2005 | Yuasa et al. | 430/108.4 |
| 2007/0218394 | A1 | 9/2007 | Mizobe et al. | |

FOREIGN PATENT DOCUMENTS

| | | | |
|---|---|---|---|
| JP | 3-126045 | A | 5/1991 |
| JP | 2007-219321 | A | 8/2007 |
| JP | 2007-248971 | A | 9/2007 |

* cited by examiner

*Primary Examiner* — Hoan Tran
(74) *Attorney, Agent, or Firm* — Sughrue Mion, PLLC

(57) ABSTRACT

An image forming apparatus includes a first image forming unit and a second image forming unit, wherein the first image forming unit is arranged on a downstream side of the second image forming unit in a traveling direction of a transfer medium, the first developing unit contains a first developer containing a first toner and a first carrier, the second developing unit contains a second developer containing a second toner and a second carrier, and a ratio of a resistance value of the first carrier to a resistance value of the second carrier is within a range of from $4.0\times10^{-5}$ to $9.7\times10^{-1}$.

14 Claims, 2 Drawing Sheets

IMAGE FORMING APPARATUS, ELECTROSTATIC CHARGE IMAGE DEVELOPING CARRIER SET, AND PROCESS CARTRIDGE SET

CROSS-REFERENCE TO RELATED APPLICATIONS

This application is based on and claims priority under 35 USC 119 from Japanese Patent Application No. 2014-178200 filed Sep. 2, 2014.

BACKGROUND

1. Technical Field

The present invention relates to an image forming apparatus, an electrostatic charge image developing carrier set, and a process cartridge set.

2. Related Art

In electrophotography, an electrostatic charge image formed on a surface of an image holding member (photoreceptor) is developed using a developer containing toner to forma toner image, and the obtained toner image is transferred to a recording medium and fixed with a heating roll or the like, thereby obtaining an image.

SUMMARY

According to an aspect of the invention, there is provided an image forming apparatus including:

a first image forming unit that includes a first image holding member and a first developing unit that develops an electrostatic charge image formed on a surface of the first image holding member; and a second image forming unit that includes a second image holding member and a second developing unit that develops an electrostatic charge image formed on a surface of the second image holding member, wherein the first image forming unit is arranged on a downstream side of the second image forming unit in a traveling direction of a transfer medium, the first developing unit contains a first developer containing a first toner and a first carrier, the second developing unit contains a second developer containing a second toner and a second carrier, wherein a ratio of a resistance value of the first carrier to a resistance value of the second carrier is within a range of from $4.0\times10^{-5}$ to $9.7\times10^{-1}$.

BRIEF DESCRIPTION OF THE DRAWINGS

Exemplary embodiments of the present invention will be described in detail based on the following figures, wherein.

DETAILED DESCRIPTION

Figure 1:
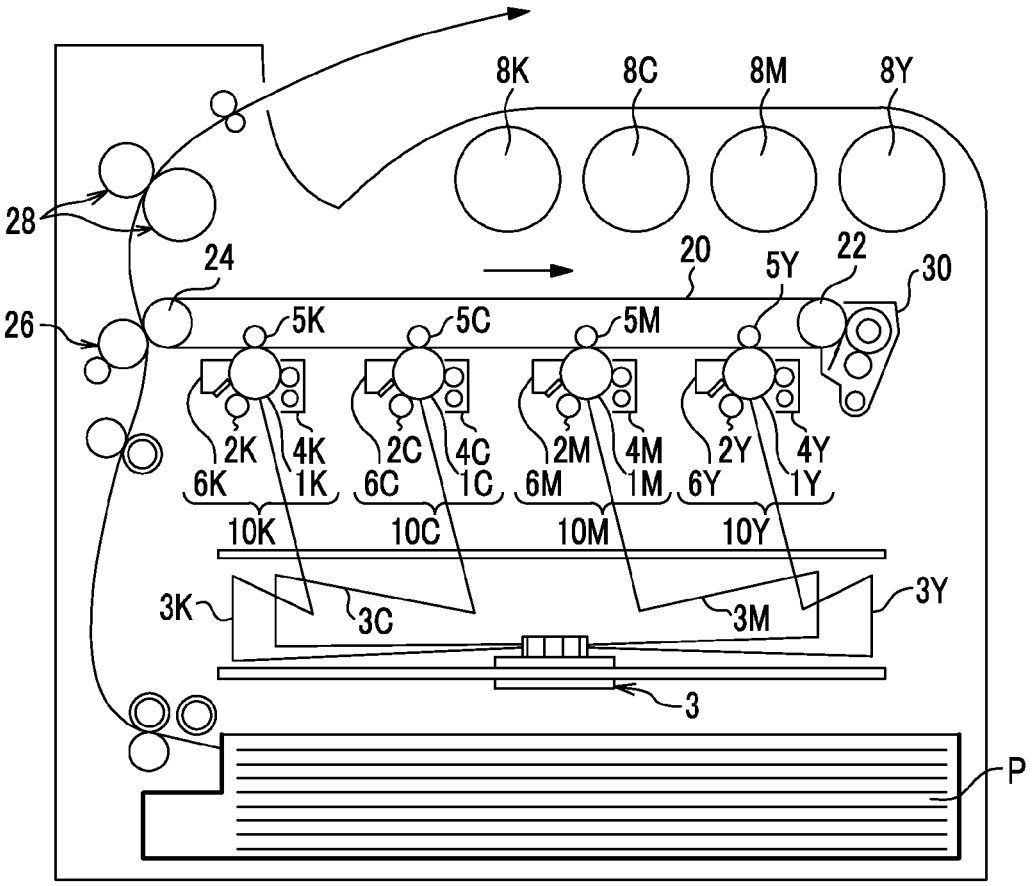
FIG. 1 is a diagram schematically illustrating a configuration of an example of an image forming apparatus according to an exemplary embodiment of the invention.

Hereinafter, an exemplary embodiment which is an example of the invention will be described in detail.

Image Forming Apparatus and Image Forming Method

An image forming apparatus and an image forming method according to the exemplary embodiment will be described.

The image forming apparatus according to the exemplary embodiment includes a first image forming unit and a second image forming unit, wherein the first image forming unit is arranged on a downstream side of the second image forming unit in a traveling direction of a transfer medium, the first developing unit contains a first developer containing a first toner and a first carrier, and the second developing unit contains a second developer containing a second toner and a second carrier, wherein a ratio (Resistance Value of First Carrier/Resistance Value of Second Carrier) of a resistance value of the first carrier to a resistance value of the second carrier is within a range of from $4.0\times10^{-5}$ to $9.7\times10^{-1}$.

More specifically, the image forming apparatus according to the exemplary embodiment includes plural image forming units (hereinafter, also referred to simply as "units") that are arranged in a traveling direction of a transfer medium. Among these plural image forming units, a first unit is provided on the most downstream side in the traveling direction of the transfer medium. In addition, one or plural second units are provided on an upstream side of the first unit, arranged on the most downstream side, in the traveling direction of the transfer medium.

The first unit includes: a first image holding member; and a first developing unit which develops an electrostatic charge image formed on a surface of the first image holding member to form a toner image thereon. In addition, the second unit includes: a second image holding member; and a second developing unit which develops an electrostatic charge image formed on a surface of the second image holding member to form a toner image thereon. The first developing unit accommodates a first developer containing a first toner and a first carrier, and the second developing unit accommodates a second developer containing a second toner and a second carrier.

In addition, the image forming apparatus according to the exemplary embodiment includes a first transfer unit and a second transfer unit. The first transfer unit transfers the toner image, which is formed on the surface of the first image holding member by the first developing unit, to the transfer medium. The second transfer unit transfers the toner image, which is formed on the surface of the second image holding member by the second developing unit, to the transfer medium.

A ratio (Resistance Value of First Carrier/Resistance Value of Second Carrier) of a resistance value of the first carrier to a resistance value of the second carrier is within a range of from $4.0\times10^{-5}$ to $9.7\times10^{-1}$.

In the first unit of the image forming apparatus according to the exemplary embodiment, a first image forming process is performed, the first image forming process including: a first developing process of developing the toner image formed on the surface of the first image holding member using the first developer containing the first toner and the first carrier. In addition, in the second unit, a second image forming process is performed, the second image forming process including: a second developing process of developing the toner image formed on the surface of the second image holding member using the second developer containing the second toner and the second carrier.

Further, a first transfer process of transferring the toner image formed on the surface of the first image holding member to the transfer medium is performed, and a second transfer process of transferring the toner image formed on the surface of the second image holding member to the transfer medium is performed.

In an image forming method (image forming method according to the exemplary embodiment) which is performed by the image forming apparatus, a ratio (Resistance Value of First Carrier/Resistance Value of Second Carrier) of a resistance value of the first carrier to a resistance value of the second carrier is within a range of from $4.0\times10^{-5}$ to $9.7\times10^{-1}$.

The "transfer medium" described herein refers to a medium to which a toner image formed on a surface of an image holding member is transferred. For example, the transfer medium is a recording medium in a direct transfer type apparatus in which a toner image formed on a surface of an image holding member is directly transferred to a recording medium. In addition, the transfer medium is an intermediate transfer member in an intermediate transfer type apparatus in which a toner image formed on a surface of an image holding member is primarily transferred to a surface of an intermediate transfer member, and the toner image transferred to the surface of the intermediate transfer member is secondarily transferred to a surface of a recording medium.

"The first image forming unit which is arranged on the most downstream side in the traveling direction of the transfer medium" refers to the unit which is arranged on the most downstream side among the plural units arranged in the traveling direction of the transfer medium. That is, the first image forming unit forms the toner image, which is transferred to the transfer medium, lastly among the plural units arranged in the traveling direction of the transfer medium.

The second unit "which is arranged on the upstream side of the first image forming unit in the traveling direction of the transfer medium" refers to the unit which is arranged on the upstream side of the first unit arranged on the most downstream side among the plural units arranged in the traveling direction of the transfer medium. In addition, "one or plural second image forming units" represents that one or plural second units are provided.

That is, among the plural units arranged in the traveling direction of the transfer medium, one or plural second units form the toner images, which are transferred to the transfer medium, on the upstream side of the first unit.

For example, when there is one second unit, the one second unit is provided on the upstream side of the first unit. In addition, when there are three second units, the three second units are provided on the upstream side of the first unit. Further, in this case, three second carriers in second developers are accommodated in second developing units of the second units.

In addition, in regard to "the second transfer unit that transfers the toner image, which is formed on the surface of the second image holding member by the second developing unit of the second image forming unit, to the transfer medium", for example, when there are three second units, three second transfer units are provided.

"A ratio of a resistance value of the first carrier to a resistance value of the second carrier is within a range of from $4.0\times10^{-5}$ to $9.7\times10^{-1}$" represents that a ratio of the resistance value of the first carrier to the resistance value of each second carrier is within the above-described specific range.

That is, for example, when there are three second carriers, all the ratios of the resistance values are within the range of from $4.0\times10^{-5}$ to $9.7\times10^{-1}$, the ratios including: a ratio of the resistance value of the first carrier to the resistance value of the second carrier (first); a ratio of the resistance value of the first carrier to the resistance value of the second carrier (second); and a ratio of the resistance value of the first carrier to the resistance value of the second carrier (third).

In addition, "a ratio of a resistance value of the first carrier to a resistance value of the second carrier" is obtained by measuring the resistance values of the unused carriers. Further, it is preferable that, even when images are continuously printed (for example, when 10,000 images are continuously printed for 10 days), the above-described specific range be satisfied.

As described above, in the image forming apparatus according to the exemplary embodiment, the image forming method is performed using the carrier which satisfies the relationship in which the ratio of the resistance value of the first carrier, which is contained in the developer accommodated in the first developing unit of the first image forming unit, to the resistance value of the second carrier, which is contained in the developer accommodated in the developing unit of the second image forming unit, is within the range of from $4.0\times10^{-5}$ to $9.7\times10^{-1}$. When an image is formed using this image forming apparatus, a difference in the variation in the resistance value between the respective carriers contained in the respective developers is suppressed.

The reason is not clear but is presumed to be as follows.

In a case where an image is formed using electrophotography, when a developer containing a carrier (hereinafter, "developer" will also referred to as "electrostatic charge image developer") is continuously used, the resistance value of the carrier changes due to a change in the carrier surface structure caused by the peeling of a coating film on the carrier surface or by the contamination of the carrier. In an image formed using the developer in which the resistance value of the carrier further varies, fogging or the like occurs. In order to prevent fogging or the like, the unused developer is added to promote the replacement of the developer. In particular, under a condition in which images having a low image density (for example, 2% or lower) are continuously printed, the amount of the developer to be added is small. Therefore, the resistance value of the carrier in the developer is likely to vary.

For example, in the image forming apparatus which includes plural units arranged in the traveling direction of the transfer medium, in many cases, a black developer is used as the developer which is accommodated in the developing unit of the first unit arranged on the most downstream side in the traveling direction of the transfer medium because the developer is affected by contamination or the like caused by other developers during the transfer process. In addition, in general, since the black developer is more frequently used to form an image, the operation time of the developing unit which accommodates the black developer of the first unit arranged on the most downstream side is longer than the operation time of the developing unit of the second unit arranged on upstream side of the first unit. Therefore, the use frequency of the black developer is the highest, and the resistance value of the first carrier contained in the black developer is more likely to vary as compared to that of the second carrier contained in the developer which is accommodated in the developing unit of the second unit arranged on the upstream side of the first unit.

Incidentally, when the carrier resistance value decreases, a brush structure of a magnetic brush of a developing roll (magnetic roll) is softened due to charge neutralization, and thus a variation in the carrier caused by interference with an image holding member (photoreceptor) or a layer restricting member is suppressed. Therefore, it is considered that, by decreasing the resistance value of the carrier used in the black developer, a variation in the resistance value of the carrier in the black developer may be suppressed.

Accordingly, in order for the ratio of the resistance values to be within the above-described specific range, the resistance value of the first carrier in the black developer which is accommodated in the developing unit in the first unit arranged on the most downstream side is controlled to be lower than the resistance value of the second carrier in another developer which is accommodated in the developing unit of the second unit arranged on the upstream side of the first unit. As a result, it is considered that a difference in the variation of the resistance value between the first carrier in the black developer and the second carrier in the other developer is suppressed.

In this example, as the developer which is accommodated in the developing unit of the first unit arranged on the most downstream side, the black developer is used, but the developer is not limited to the black developer. For example, even when the developer which is accommodated in the developing unit of the first unit arranged on the most downstream side is applied to an undercoat developer (for example, a white developer) or a protective developer (for example a transparent developer), a difference in the variation of the resistance value between the respective carriers is suppressed.

In addition, in an image which is formed by the image forming apparatus according to the exemplary embodiment, a variation in the resistance value of the carrier in the developer which is accommodated in the developing unit of the first unit arranged on the most downstream side is suppressed, and thus the fogging or the like of the image caused by the variation is prevented. In particular, under a condition in which images having a low image density are continuously formed, fogging or the like is prevented. In addition, a difference between the variation in the resistance value of the first carrier in the developer, which is accommodated in the developing unit of the first unit arranged on the most downstream side, and the variation in the resistance value of the second carrier in the developer, which is accommodated in the developing unit of the second unit arranged on the upstream side of the first unit arranged on the most downstream side, is suppressed, and thus the scattering of the carriers caused by the difference is prevented.

When the resistance value of the carrier in the developer (for example, the carrier in the black developer) which is accommodated in the developing unit of the first unit arranged on the most downstream side is excessively low, a charge is injected into a magnetic brush, and the carrier is likely to be scattered. In addition, when the resistance value of the carrier in this developer is excessively high, in a halftone image which is formed immediately after a solid image is formed, the toner which is developed on an image holding member is likely to return to the carrier due to the charge held in the carrier after the development. Therefore, a decrease in density or image deletion (white void) is likely to occur.

As the image forming apparatus according to the exemplary embodiment, various well-known image forming apparatuses may be used, the apparatuses including: a direct transfer type apparatus in which a toner image formed on a surface of an image holding member is directly transferred to a recording medium; an intermediate transfer type apparatus in which a toner image formed on a surface of an image holding member is primarily transferred to a surface of an intermediate transfer member, and the toner image transferred to the surface of the intermediate transfer member is secondarily transferred to a surface of a recording medium; an apparatus including a cleaning unit that cleans a surface of an image holding member after a toner image is transferred and before charging; and an apparatus including an erasing unit that irradiates a surface of an image holding member with erasing light for erasing charged after a toner image is transferred and before charging.

In the intermediate transfer type apparatus, for example, a transfer unit includes: an intermediate transfer member having a surface to which a toner image is transferred; a primary transfer unit that primarily transfers a toner image, which is formed on a surface of an image holding member, to the surface of the intermediate transfer member; and a secondary transfer unit that secondarily transfers the toner image, which is transferred to the surface of the intermediate transfer member, to a surface of a recording medium.

In the image forming apparatus according to the exemplary embodiment, for example, a portion including the developing unit may have a cartridge structure (process cartridge) which is detachable from the image forming apparatus.

Hereinafter, the image forming apparatus according to the exemplary embodiment will be described using, as an example, an intermediate transfer type apparatus in which a toner image formed on a surface of an image holding member is primarily transferred to a surface of an intermediate transfer member, and the toner image transferred to the surface of the intermediate transfer member is secondarily transferred to a surface of a recording medium. However, the image forming apparatus is not limited to the intermediate transfer type apparatus. Major components illustrated in the drawings will be described, and the other components will not be described.

FIG. 1 is a diagram schematically illustrating a configuration of the image forming apparatus according to the exemplary embodiment.

The image forming apparatus illustrated in FIG. 1, includes electrophotographic image forming units 10Y, 10M, 10C, and 10K (image forming units) that form images of the respective colors including yellow (Y), magenta (M), cyan (C), and black (K) based on color-separated image data. These image forming units 10Y, 10M, 10C, and 10K are horizontally arranged in parallel at predetermined intervals. These units 10Y, 10M, 10C, and 10K may be process cartridges which are detachable from the image forming apparatus.

An intermediate transfer belt 20 (an example of the transfer medium) which is the intermediate transfer member extends through a region above the respective units 10Y, 10M, 10C, and 10K in the drawing. The intermediate transfer belt 20 is wound around a drive roll 22 and a support roll 24 which are arranged to be distant from each other in a direction from the left to the right in the drawing, in which the support roll contacts with the inner surface of the intermediate transfer belt 20. The intermediate transfer belt 20 travels in a direction from the unit 10Y to the unit 10K. A force is applied to the support roll 24 by a spring or the like (not illustrated) in a direction away from the drive roll 22, and a tension is applied to the intermediate transfer belt 20 wound around the drive roll 22 and the support roll 24. In addition, an intermediate transfer member cleaning device 30 is provided on an image holding member-side surface of the intermediate transfer belt 20 to be opposite to the drive roll 22.

In addition, toners of four colors including yellow, magenta, cyan, and black which are accommodated in toner cartridges 8Y, 8M, 8C, and 8K are supplied to developing devices (developing units) 4Y, 4M, 4C, and 4K of the respective units 10Y, 10M, 10C, and 10K, respectively.

In the image forming apparatus illustrated in FIG. 1, the units 10Y, 10M, 10C, and 10K contain photoreceptors (image holding members) 1Y, 1M, 1C, and 1K and developing devices (an example of the developing unit) 4Y, 4M, 4C, and 4K, respectively. At this time, the unit 10K is the first image forming unit (an example of the first image forming unit) which is arranged on the most downstream side in a traveling direction of the intermediate transfer belt 20 which is an example of the transfer medium. In addition, the units 10Y, 10M, and 10C are the second image forming units (an example of the second image forming unit) which are arranged on the upstream side of the image forming unit on the most downstream side in the traveling direction. Further, a primary transfer roll 5K (an example of the transfer unit (primary transfer unit)) is an example of the first transfer unit, and primary transfer rolls 5Y, 5M, and 5C are examples of the second transfer unit.

Since the first unit 10K and the second units 10Y, 10M, and 10C have the same configuration, the unit 10Y (an example of the unit which is arranged on the most upstream side among the second units) which is arranged on the most upstream side in the traveling direction of the intermediate transfer belt and forms a yellow image will be described as a representative example. The same components as those of the unit 10Y which is arranged on the most upstream side among the second units are represented by reference numerals to which the symbols M (magenta), C (cyan), and K (black) are attached instead of the symbol Y (yellow), and the second units 10M and 10C and the first unit 10K will not be described.

The unit 10Y includes a photoreceptor 1Y which functions as the image holding member. Around the photoreceptor 1Y, a charging roll (an example of the charging unit) 2Y that charges a surface of the photoreceptor 1Y to a predetermined potential; an exposure device (an example of the electrostatic charge image forming unit) 3 that exposes the charged surface to a laser beam 3Y based on a color-separated image signal to form an electrostatic charge image thereon; a developing device (an example of the developing unit) 4Y that supplies charged toner to the electrostatic charge image to develop the electrostatic charge image; a primary transfer roll (an example of the primary transfer unit) 5Y that transfers the developed toner image to the intermediate transfer belt 20; and a photoreceptor cleaning device (an example of the cleaning unit) 6Y that removes the toner remaining on the surface of the photoreceptor 1Y after the primary transfer, are arranged in this order.

The primary transfer roll 5Y is arranged inside the intermediate transfer belt 20 and is provided at a position opposite to the photoreceptor 1Y. Further, bias power supplies (not illustrated) are connected to the primary transfer rolls 5Y, 5M, 5C, and 5K to apply primary transfer biases thereto. A controller (not illustrated) controls the respective bias power supply to change the transfer biases which are applied to the respective primary transfer rolls.

Hereinafter, the operation of forming the yellow image in the unit 10Y will be described.

First, before the operation, the surface of the photoreceptor 1Y is charged to a potential of −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or lower). This photosensitive layer typically has high resistance (resistance of a general resin) but has a property in which, when being irradiated with the laser beam 3Y, the specific resistance of the portion irradiated with the laser beam changes. Therefore, the charged surface of the photoreceptor by is irradiated with the laser beam 3Y through the exposure device 3 according to image data for yellow sent from the controller (not illustrated). The photosensitive layer of the surface of the photoreceptor 1Y is irradiated with the laser beam 3Y, and thus an electrostatic charge image of a yellow image pattern is formed on the surface of the photoreceptor 1Y.

The electrostatic charge image is an image which is formed on the surface of the photoreceptor 1Y by charging and is a so-called negative latent image which is formed when the specific resistance of a portion, which is irradiated with the laser beam 3Y, of the photosensitive layer is reduced and the charge flows on the surface of the photoreceptor 1Y, and when the charge remains in a portion which is not irradiated with the laser beam 3Y.

The electrostatic charge image formed on the photoreceptor 1Y is rotated to a predetermined development position along with the traveling of the photoreceptor 1Y. At this development position, the electrostatic charge image on the photoreceptor 1Y is visualized (developed) as a toner image by the developing device 4Y.

The developing device 4Y accommodates, for example, a developer containing at least a yellow toner and a carrier. The yellow toner is frictionally charged by being agitated in the developing device 4Y to have a charge having the same polarity (negative polarity) as that of a charge on the photoreceptor 1Y and is maintained on a developer roll (an example of the developer holding member). When the surface of the photoreceptor 1Y passes through the developing device 4Y, the yellow toner is electrostatically attached to a latent image portion on the surface of the photoreceptor 1Y which is erased, and the latent image is developed with the yellow toner. The photoreceptor 1Y on which a yellow toner image is formed continuously travels at a predetermined rate, and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y, an electrostatic force is applied to the toner image in a direction from the photoreceptor 1Y to the primary transfer roll 5Y, and the toner image on the photoreceptor 1Y is transferred to the intermediate transfer belt 20. The transfer bias applied at this time has a positive polarity opposite to the negative polarity of the toner. For example, in the unit 10Y which is arranged on the most upstream side, the transfer bias is controlled to +10 μA by the controller (not shown).

On the other hand, the toner remaining on the photoreceptor 1Y is removed and collected by the photoreceptor cleaning device 6Y.

In addition, primary transfer biases which are applied to the primary transfer rolls 5M and 5C of the remaining second unit 10M and subsequent units following the unit 10Y, arranged on the most upstream side among the second units, and the primary transfer roll 5K of the first unit 10K, respectively, are controlled in a similar way to that of the primary transfer bias of the unit arranged on the most upstream side.

In this way, the intermediate transfer belt 20 to which the yellow toner image is transferred by the unit 10Y arranged on the most upstream side among the second units is sequentially transported through the units 10M and 10C following the unit 10Y and the first unit 10K, and toner images of the respective colors are superimposed and multi-transferred.

The intermediate transfer belt 20 to which the four color toner images are multi-transferred by the three second units and the first unit reaches a secondary transfer portion which is configured with the intermediate transfer belt 20, the support roll 24, and a secondary transfer roll 26 (an example of the secondary transfer unit), in which the support roll 24 contacts with the inner surface of the intermediate transfer belt, and the secondary transfer roll 26 is arranged on an image holding surface side of the intermediate transfer belt 20. Meanwhile, a recording sheet P (an example of the recording medium) is supplied to a gap at which the secondary transfer roll 26 and the intermediate transfer belt 20 contact with each other at a predetermined timing through a supply mechanism, and a predetermined secondary transfer bias is applied to the support roll 24. The transfer bias applied at this time has the negative polarity which is the same as the polarity of the toner, and an electrostatic force is applied to the toner image in a direction from the intermediate transfer belt 20 to the recording sheet P. As a result, the toner image on the intermediate transfer belt 20 is transferred to the recording sheet P. At this time, the secondary transfer bias is determined depending on a resistance detected by a resistance detecting unit (not illustrated) which detects a resistance of the secondary transfer portion, and the voltage is controlled.

Thereafter, the recording sheet P is fed to a press-contact portion (nip portion) of a pair of fixing rolls in a fixing device 28 (an example of the fixing unit), and the toner image is fixed onto the recording sheet P to forma fixed image.

Examples of the recording sheet P to which the toner image is transferred include plain paper used for electrophotographic copying machines, printers and the like. As the recording medium, in addition to the recording sheet P, OHP sheets may be used.

In order to further improve the smoothness of the image surface after the fixing, the surface of the recording sheet P is preferably smooth, and for example, coated paper obtained by coating the surface of plain paper with a resin or the like, or art paper for printing is suitably used.

The recording sheet P onto which a color image is completely fixed is discharged to an exit port, and a series of the color image formation operations ends.

In the image forming apparatus according to the exemplary embodiment, the image forming method is performed using the carrier which satisfies the relationship in which the ratio of the resistance value of the first carrier, which is contained in the first developer accommodated in the first developing device 4K of the first unit 10K, to each of the resistance values of the second carriers, which are contained in the second developers accommodated in the second developing devices 4Y, 4M, and 4C of the second units 10Y, 10M, and 10C, is within the range of from $4.0\times10^{-5}$ to $9.7\times10^{-1}$. With the image forming apparatus according to the exemplary embodiment, a difference in the variation in the resistance value between the respective carriers contained in the respective developers is suppressed.

Electrostatic Charge Image Developing Carrier Set

The electrostatic charge image developing carrier set (hereinafter, also referred to simply as "carrier set") according to the exemplary embodiment is the carrier set including: the first carrier that is accommodated in the first developing unit of the first image forming unit and is contained in the first developer; and the second carrier that is accommodated in the second developing unit of the second image forming unit and is contained in the second developer.

In the carrier set, a ratio (Resistance Value of First Carrier/Resistance Value of Second Carrier) of a resistance value of the first carrier to a resistance value of the second carrier is within a range of from $4.0\times10^{-5}$ to $9.7\times10^{-1}$.

Hereinafter, the carriers used in the carrier set according to the exemplary embodiment will be described in detail.

Carrier

The first carrier and the second carrier are not particularly limited as long as they are prepared such that the resistance values thereof satisfy the above-described specific range, and well-known ones may be used. For example, a carrier including core particle and a resin coating layer that coats the core particle may be used.

Resistance Value of Carrier (Volume Resistivity Value (25° C.))

From the viewpoint of preventing image quality deterioration such as fogging or white void, it is preferable that the resistance values of the first carrier and the second carrier at 1000 V corresponding to the upper and lower limits of a typical development contrast potential be within a range of from $1\times10^{6}$ Ω·cm to $1\times10^{14}$ Ω·cm. In this range, a high-quality image in which image quality deterioration such as fogging or white void is prevented may be easily obtained. Further, it is more preferable that the resistance values of the first carrier and the second carrier be within a range of from $1\times10^{7}$ Ω·cm to $1\times10^{13}$ Ω·cm.

The volume resistivity of the carrier is measured as follows.

The developer in the developing device is separated into the toner and the carrier by air blow to extract the carrier therefrom. Next, the extracted carrier is placed flat on a surface of a circular jig on which a 20 $cm^2$ electrode plate is disposed such that the thickness thereof is from 1 mm to 3 mm, thereby forming a layer. Another 20 $cm^2$ electrode plate is disposed on the layer such that the layer is interposed between the electrode plates. In order to remove a gap in a measurement target, a load of 4 kg is applied to the electrode plate disposed above the layer, and then the thickness (cm) of the layer is measured. Both of the electrodes disposed above and below the layer are connected to an electrometer and a high-voltage power supply. A high voltage is applied to both the electrodes so as to generate an electric field of 103.8 V/cm, and a current value (A) flowing at this time is read. The measurement environment is an applied voltage of 1000 V, a temperature of 20° C., and a humidity of 50% RH. An expression of calculating the volume electric resistance (Ω·cm) of the measurement target is as follows.

$$R=E\times20/(I-I_0)/L$$

In the above expression, R represents the volume electric resistance (Ω·cm) of the measurement target, E represents the applied voltage (V), I represents the current value (A), $I_0$ represents the current value (A) at an applied voltage of 0 V, and L represents the thickness (cm) of the layer. The coefficient 20 represents the area ($cm^2$) of the electrode plates.

Control of Carrier Resistance Value

The respective resistance values of the first carrier and the second carrier are controlled such that the ratio of the resistance value of the first carrier to the resistance value of the second carrier satisfies the above-described specific range. The resistance values of the carries may be controlled by preparing the carriers, for example, through the control of the coating amount of a resin coating layer described below, the content of conductive particles, which may be used in the resin coating layer, in the resin coating layer, and a combination thereof.

From the viewpoint of controlling the resistance values of the carriers, in each of the first carrier and the second carrier, the resin coating amount of the resin coating layer with respect to the core particles is, for example, 0.5% by weight or more (preferably from 0.7% by weight to 6.0% by weight and more preferably from 1.0% by weight to 5.0% by weight) with respect to the total amount of the carrier.

The resin coating amount of the resin coating layer is obtained as follows.

In the case of a resin coating layer that is soluble in a solvent, a carrier that has been accurately weighed is dissolved in a soluble solvent (for example, toluene), the core particles are held with a magnet, and the solution in which the resin coating layer is dissolved is rinsed away. By repeating this operation several times, the core particles from which the resin coating layer has been removed remain. The weight of the core particles after being dried is measured, and then the difference is divided by the amount of carrier to calculate the coating amount.

Specifically, 20.0 g of a carrier is weighed and put into a beaker, 100 g of toluene is added thereto, and the mixture is stirred with a stirring blade for 10 minutes. A magnet is placed under the bottom of the beaker, and the toluene is rinsed away such that the core particles do not flow out. This operation is repeated four times, and the beaker after the toluene is rinsed away is dried. The amount of the core particles after the drying is measured, and the coating amount is calculated from the expression "(Carrier Amount−Amount of Core Particles After Washing)/Carrier Amount".

On the other hand, in the case of a coating layer that is insoluble in a solvent, a carrier is heated in a nitrogen atmosphere in a range of from room temperature (25° C.) to 1,000° C. using a Thermo plus EVO II differential thermogravimetric analyzer TG 8120 (manufactured by Rigaku Corporation). The coating amount is calculated from a decrease in the weight of the carrier.

When the resin coating layer contains conductive particles, the content of the conductive particles in the resin coating layer is, for example, preferably from 0.1% by weight to 50% by weight from the viewpoint of controlling the carrier resistance value.

Hereinafter, common configurations of the first carrier and the second carrier will be described.

Core Particles

Examples of the core particles according to the exemplary embodiment include magnetic metal particles (for example, particles of iron, steel, nickel, or cobalt), magnetic oxide particles (for example, particles of ferrite or magnetite), and magnetic particle-dispersed resin particles in which the above particles are dispersed in a resin. In addition, examples of the core particles include particles obtained by impregnating porous magnetic powder with a resin.

It is preferable that the core particles be ferrite particles represented by, for example, the following formula.

Formula: $(MO)_X(Fe_2O_3)_Y$

In the formula, Y represents 2.1 to 2.4, and X represents 3−Y. M represents a metal element and preferably contains at least Mn as the metal element.

M contains Mn as a major component and may further contain at least one element selected from the group consisting of Li, Ca, Sr, Sn, Cu, Zn, Ba, Mg, and Ti (preferably, the group consisting of Li, Ca, Sr, Mg, and Ti from the viewpoint of the environment).

The core particles are obtained by magnetic granulation or sintering, and as a pre-treatment, the magnetic materials may be pulverized. A pulverization method is not particularly limited. For example, a well-known pulverization method may be used, and specific examples thereof include methods using a mortar, a ball mill, and a jet mill.

The resin contained in the magnetic particle-dispersed resin particles which are the core particles are not particularly limited, and examples thereof include styrene resins, acrylic resins, phenol resins, melamine resins, epoxy resins, urethane resins, polyester resins, and silicone resins. In addition, optionally, other components such as a charge-controlling agent or fluorine-containing particles may be further added to the magnetic particle-dispersed resin particles which are the core particle.

A volume average particle diameter of the core particles is, for example, from 10 μm to 500 μm, and is preferably from 15 μm to 80 μm and more preferably from 20 μm to 60 μm.

Resin Coating Layer

Examples of the coating resin of the resin coating layer include acrylic resins, polyethylene resins, polypropylene resins, polystyrene resins, polyacrylonitrile resins, polyvinylacetate resins, polyvinylalcohol resins, polyvinylbutyral resins, polyvinyl chloride resins, polyvinyl carbazole resins, polyvinyl ether resins, polyvinyl ketone resins, vinyl chloride-vinyl acetate copolymers, styrene-acrylic acid copolymers, straight silicone resins having an organosiloxane bond or modified compounds thereof, fluororesins, polyester resins, polyurethane resins, polycarbonate resins, phenol resins, amino resins, melamine resins, benzoguanamine resins, urea resins, amide resins, and epoxy resins.

The resin coating layer may further contain resin particles for the purposes of charge control and the like, or may further contain conductive particles for the purposes of resistance control and the like. The coating layer may further contain other additives.

The resin particles are not particularly limited. For example, a charge-controlling material is preferable, and examples thereof include melamine resin particles, urea resin particles, urethane resin particles, polyester resin particles, and acrylic resin particles.

Examples of the conductive particles include carbon black particles, various metal powders, and metal oxide particles (for example, particles of titanium oxide, tin oxide, magnetite, and ferrite). Among these, one kind may be used alone, two or more kinds may be used in combination. Among these, carbon black particles are preferably used from the viewpoints of manufacturing stability, cost, conductivity, and the like. The kind of the carbon black is not particularly limited. For example, carbon black having a DBP absorption of from 50 ml/100 g to 250 ml/100 g is preferably used from the viewpoint of manufacturing stability.

A method of forming the resin coating layer on the surfaces of the core particles is not particularly limited, and a well-known method may be adopted. Examples of the method include a dipping method in which a resin coating layer-forming solution is prepared, and the core particles are dipped in the resin coating layer-forming solution; a spray method in which a resin coating layer-forming solution is sprayed on the surfaces of the core particles; a fluidized bed method in which a resin coating layer-forming solution is sprayed on the core particles while floating the core particles with flowing air; a kneader coater method in which the core particles and a resin coating layer-forming solution are mixed in a kneader coater, and then a solvent is removed; and a powder coating method in which the core particles and resin powder are heated and mixed. Further, after being formed, the resin coating layer may be heated using a device such as an electric furnace or a kiln.

Other Properties of Carrier

A volume average particle diameter of the carrier is, for example, from 10 μm to 500 μm, and is preferably from 15 μm to 80 μm and more preferably from 20 μm to 60 μm.

The volume average particle diameter of the carrier is measured as follows. The volume average particle diameter of the core particles is also measured as follows.

Using a laser scattering diffraction particle diameter distribution analyzer (LS particle size analyzer; manufactured by Beckman Coulter Co., Ltd.), a particle diameter distribution is measured. As an electrolytic solution, ISOTON-II (manufactured by Beckman Coulter Co., Ltd.) is used. The number of particles to be measured is 50,000.

Using the measured particle distribution, a volume cumulative particle diameter distribution is drawn on divided particle diameter ranges (channels) from the smallest diameter side. A particle diameter having a cumulative value of 50% by volume (also referred to as "D50*v*") is defined as "volume average particle diameter".

Regarding the magnetic force of the carrier, the saturation magnetization at a magnetic field of 1000 oersted may be, for example, 40 emu/g or higher or 50 emu/g or higher.

Here, the saturation magnetization of the carrier is measured using a vibrating sample magnetometer VSMP10-15 (manufactured by Toei Industry Co., Ltd.). A measurement sample is put into a cell having an internal diameter of 7 mm and a height of 5 mm, and the cell is set to the device. In the measurement, a magnetic field is applied to the sample and is swept to 3,000 oersted at a maximum. Next, the applied magnetic field is reduced to prepare a hysteresis curve on a recording sheet. Based on this curve data, the saturation magnetization is obtained.

Electrostatic Charge Image Developer Set

The electrostatic charge image developer set according to the exemplary embodiment (hereinafter, referred to as "developer set") is the developer set including: the first developer that is accommodated in the first developing unit of the first image forming unit and contains the first carrier and the first toner; and the second developer that is accommodated in the second developing unit of the second image forming unit and contains the second carrier and the second toner.

A ratio (Resistance Value of First Carrier/Resistance Value of Second Carrier) of a resistance value of the first carrier to a resistance value of the second carrier is within a range of from $4.0\times10^{-5}$ to $9.7\times10^{-1}$.

The developer used as the first developer is not particularly limited, and in addition to a black developer, other color developers, an undercoat developer such as a white developer, and a protective developer such as a transparent developer may be used.

However, from the viewpoint of reducing the effects (for example, contamination) of other developers during the transfer process, it is preferable that a black developer be used.

A mixing ratio (weight ratio; toner:carrier) of the toner to the carrier in each of the developers of the developer set according to the exemplary embodiment is preferably 1:100 to 30:100 and more preferably 3:100 to 20:100.

Hereinafter, the toner contained in each of the developers will be described.

The toner contains toner particles. Optionally, the toner may further contain an external additive.

Hereinafter, the details of the toner according to the exemplary embodiment will be described.

The toner according to the exemplary embodiment contains toner particles and optionally further contains an external additive.

Toner Particles

The toner particles contains, for example, a binder resin and optionally further contains a colorant, a release agent, and other additives.

Binder Resin

Examples of the binder resin include vinyl resins made of a homopolymer of one monomer or copolymers of two or more monomers selected from the following monomers: styrenes (for example, styrene, parachlorostyrene, and α-methylstyrene); (meth)acrylates (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, laurylmethacrylate, and 2-ethylhexyl methacrylate); ethylenically unsaturated nitriles (for example, acrylonitrile and methacrylonitrile); vinyl ethers (for example, vinyl methyl ether and vinyl isobutyl ether); vinyl ketones (vinyl methyl ketone, vinyl ethyl ketone, and vinyl isopropenyl ketone); and olefins (for example, ethylene, propylene, and butadiene).

Examples of the binder resin include non-vinyl resins such as epoxy resins, polyester resins, polyurethane resins, polyamide resins, cellulose resins, polyether resins, and modified rosins; mixtures of the non-vinyl resins and the vinyl resins; and graft polymers obtained by polymerization of vinyl monomers in the presence of the non-vinyl resins.

Among these binder resins, one kind may be used alone, or two or more kinds may be used in combination.

The content of the binder resin is, for example, preferably from 40% by weight to 95% by weight, more preferably from 50% by weight to 90% by weight, and still more preferably from 60% by weight to 85% by weight with respect to the total amount of the toner particles.

Colorant

Examples of the colorant include various kinds of pigments such as carbon black, chrome yellow, Hansa Yellow, Benzidine Yellow, Threne Yellow, Quinoline Yellow, Pigment Yellow, Permanent Orange GTR, Pyrazolone Orange, Vulcan Orange, Watchung Red, Permanent Red, Brilliant Carmine 3B, Brilliant Carmine 6B, Du Pont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate; and various dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

Among these colorants, one kind may be used alone, or two or more kinds may be used in combination.

Optionally, the colorant may be surface-treated, or may be used in combination with a dispersant. In addition, plural kinds of colorants may be used in combination.

The content of the colorant is, for example, preferably from 1% by weight to 30% by weight and more preferably from 3% by weight to 15% by weight with respect to the total amount of the toner particles.

Release Agent

Examples of the release agent include hydrocarbon waxes; natural waxes such as carnauba wax, rice wax, and candelilla wax; synthetic or mineral and petroleum waxes such as montan wax; and ester waxes such as fatty acid ester and montanic acid ester. The release agent is not limited to these examples.

The melting temperature of the release agent is preferably from 50° C. to 110° C. and more preferably from 60° C. to 100° C.

The melting temperature is calculated from the DSC curve obtained from differential scanning calorimetry (DSC) according to a "melting peak temperature" described in a method of calculating melting temperature in "Testing methods for transition temperatures of plastics" of JIS K-1987.

The content of the release agent is, for example, preferably from 1% by weight to 20% by weight and more preferably from 5% by weight to 15% by weight with respect to the total amount of the toner particles.

Other Additives

Examples of the other additives include known additives such as a magnetic material, a charge-controlling agent, and inorganic powder. These additives are contained in the toner particles as internal additives.

Properties of Toner Particles

The toner particles may have a single-layer structure or a so-called core-shell structure including: a core (core particles) and a coating layer (shell layer) that coats the core.

Here, it is preferable that the toner particles having a core-shell structure include: a core that contains a binder resin and optionally further contains other additives such as a colorant and a release agent; and a coating layer that contains a binder resin.

The volume average particle diameter (D50*v*) of the toner particles is preferably from 2 μm to 10 μm and more preferably from 4 μm to 8 μm.

Various average particle diameters and various particle diameter distribution indices of the toner particles are measured by using COULTER MULTISIZER II (manufactured by Beckman Coulter Co., Ltd.) as a measuring device and using ISOTON-II (manufactured by Beckman Coulter Co., Ltd.) as an electrolytic solution.

During this measurement, from 0.5 mg to 50 mg of a measurement sample is added to 2 ml of an aqueous solution containing 5% of a surfactant (preferably, sodium alkylbenzene sulfonate) as a dispersant. This solution is added to from 100 ml to 150 ml of the electrolytic solution.

The electrolytic solution in which the measurement sample is suspended is dispersed with an ultrasonic disperser for 1 minute. Then, a particle diameter distribution of particles having a particle diameter in a range of 2 μm to 60 μm is measured using COULTER MULTISIZER II and an aperture having an aperture size of 100 μm. The number of particles to be sampled is 50,000.

Volume and number cumulative particle diameter distributions are respectively drawn on particle diameter ranges (channels) divided based on the measured particle distribution from the smallest diameter side. In addition, particle diameters having cumulative values of 16% by volume and number are defined as a volume particle diameter D16*v* and a number particle diameter D16*p*, respectively. Particle diameters having cumulative values of 50% by volume and number are defined as a volume average particle diameter D50*v* and a number average particle diameter D50*p*, respectively. Particle diameters having cumulative values of 84% by volume and number are defined as a volume particle diameter D84*v* and a number particle diameter D84*p*, respectively.

Using these values, a volume average particle diameter distribution index (GSDv) is calculated as $(D84v/D16v)^{1/2}$, and a number average particle diameter distribution index (GSDp) is calculated from $(D84p/D16p)^{1/2}$.

The shape factor SF1 of the toner particles is preferably from 110 to 150 and more preferably from 120 to 140.

The shape factor SF1 is obtained from the following expression.

$$\text{Expression: } SF1=(ML^2/A)\times(n/4)\times 100$$

In the expression ML represents an absolute maximum length of a toner particle, and A represents a projected area of a toner particle.

Specifically, the shape factor SF1 is converted into a numerical value by analyzing mainly a microscopic image or a scanning electron microscope (SEM) image using an image analyzer and calculated as follows. That is, an optical microscope image of particles sprayed on a glass slide surface is input to an image analyzer LUZEX through a video camera, maximum lengths and projected areas of 100 particles are obtained to calculate shape factors thereof from the above expression, and an average value thereof is obtained.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO{\cdot}SiO_2$, $K_2O{\cdot}(TiO_2)n$, $Al_2O_3{\cdot}2SiO_2$, $CaCO_3$, $MgCO_3$, $BaSO_4$, and $MgSO_4$.

Surfaces of the inorganic particles as the external additive may be treated with a hydrophobizing agent. The treatment with a hydrophobizing agent may be performed, for example, by dipping the inorganic particles in a hydrophobizing agent. The hydrophobizing agent is not particularly limited, and examples thereof include a silane coupling agent, silicone oil, a titanate coupling agent, and an aluminum coupling agent. Among these, one kind may be used alone, two or more kinds may be used in combination.

The amount of the hydrophobizing agent is from 1 part by weight to 10 parts by weight with respect to 100 parts by weight of the inorganic particles.

Examples of the external additive include resin particles (for example, resin particles of polystyrene, polymethyl methacrylate (PMMA), and melamine resin) and a cleaning agent (for example, particles of metal salts of higher fatty acids represented by zinc stearate and fluorine-based polymers).

The content of the external additive is, for example, preferably from 0.01% by weight to 5% by weight and more preferably from 0.01% by weight to 2.0% by weight with respect to the total amount of the toner particles.

Method of Preparing Toner

Next, a method of preparing a toner according to the exemplary embodiment will be described.

The toner according to the exemplary embodiment is obtained by preparing the toner particles and externally adding the external additive to the toner particles.

The toner particles may be prepared using either a dry method (for example, a kneading and pulverizing method) or a wet method (for example, an aggregation coalescence method, a suspension polymerization method, or a dissolution suspension method). The method of preparing the toner particles is not limited to these methods, and a well-known method is adopted.

Among these, an aggregation coalescence method is preferably used to obtain the toner particles.

The toner according to the exemplary embodiment is prepared, for example, by adding the external additive to the obtained dry toner particles and mixing them with each other. It is preferable that the mixing be performed using a V-blender, a HENSCHEL MIXER, or a LÖDIGE MIXER. Further optionally, coarse particles of the toner may be removed, for example, using a vibration sieve or a wind classifier.

Process Cartridge Set

A process cartridge set according to the exemplary embodiment will be described.

The process cartridge set according to the exemplary embodiment is detachable from an image forming apparatus and is the process cartridge set including: the first developing unit of the first image forming unit; and the second developing unit of the second image forming unit.

A ratio (Resistance Value of First Carrier/Resistance Value of Second Carrier) of a resistance value of the first carrier to a resistance value of the second carrier is within a range of from $4.0\times10^{-5}$ to $9.7\times10^{-1}$.

In addition, each of the process cartridges of the process cartridge set according to the exemplary embodiment is not limited to the above-described configuration, and may include the developing device (developing unit) and optionally at least one component selected from other units such as an image holding member, a charging unit, an electrostatic charge image forming unit, and a transfer unit.

Hereinafter, an example of one process cartridge constituting the process cartridge set according to the exemplary embodiment will be described, but the process cartridge is not limited thereto. Major components illustrated in the drawings will be described, and the other components will not be described.

Figure 2:
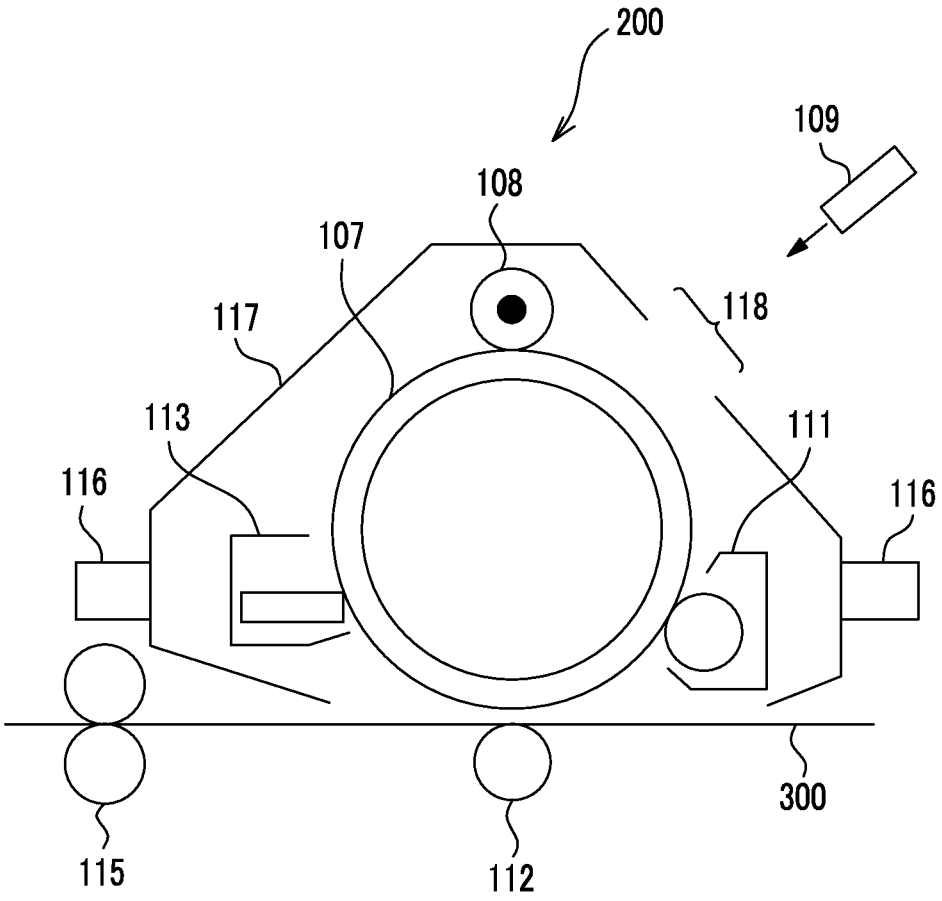
FIG. 2 is a diagram schematically illustrating a configuration of an example of a process cartridge according to an exemplary embodiment of the invention.

FIG. 2 is a diagram schematically illustrating a configuration of the process cartridge according to the exemplary embodiment.

A process cartridge 200 illustrated in FIG. 2 is, for example, a cartridge in which a photoreceptor 107 (an example of the image holding member), and a charging roll 108 (an example of the charging unit), a developing device 111 (an example of the developing unit), and a photoreceptor cleaning device 113 (an example of the cleaning unit), which are provided around the photoreceptor 107 are integrally combined in a housing 117 including a mounting rail 116 and an opening 118 for exposure.

In FIG. 2, reference numeral 109 represents an exposure device (an example of the electrostatic charge image forming unit), reference numeral 112 represents a transfer device (an example of the transfer unit), reference numeral 115 represents a fixing device (an example of the fixing unit), and reference numeral 300 represents a recording sheet (an example of the recording medium).

EXAMPLES

Hereinafter, the exemplary embodiment will be described in detail using Examples but is not limited to these examples. In the following description, unless specified otherwise, "part(s)" and "%" represent "part(s) by weight" and "% by weight".

Preparation of Carrier

Preparation of Carrier 1

Mn—Mg ferrite particles (volume average particle diameter: 35 μm): 100 parts

Cyclohexyl methacrylate/methyl methacrylate copolymer: 3 parts (copolymer molar ratio: 95:5, Mw: 10000)

Carbon black (VXC72, manufactured by Cabot Corporation): 0.3 part

Toluene: 14 parts

Among the components constituting the carrier composition described above, the respective components other than the Mn—Mg ferrite particles and glass beads (ϕ1 mm, the same amount as that of toluene) are stirred using a sand mill (manufactured by Kansai Paint Co., Ltd.) at 1200 ppm for 30 minutes. As a result, Resin coating layer-forming solution 1 is obtained. Further, this Resin coating layer-forming solution 1 and the Mn—Mg ferrite particles are put into a vacuum degassing type kneader, and toluene is removed by distillation. As a result, a carrier coated with a resin is formed. Next, fine powder and coarse powder are removed using an elbow jet. As a result, Carrier 1 is obtained.

Preparation of Carrier 2

Carrier 2 is obtained with the same preparation method as that of Carrier 1, except that Mn—Mg ferrite particle (volume average particle diameter: 25 μm) is used instead of Mn—Mg ferrite particle (volume average particle diameter: 35 μm).

Preparation of Carrier 3

Carrier 3 is obtained with the same preparation method as that of Carrier 1, except that Mn—Mg ferrite particle (volume average particle diameter: 25 μm) is used instead of Mn—Mg ferrite particle (volume average particle diameter: 35 μm); and carbon black is not used.

Preparation of Carrier 4

Carrier 4 is obtained with the same preparation method as that of Carrier 1, except that Mn—Mg ferrite particle (volume average particle diameter: 25 μm) is used instead of Mn—Mg ferrite particle (volume average particle diameter: 35 μm); and the amount of carbon black is changed from 0.3 part to 10 parts.

Preparation of Carrier 5

Carrier 5 is obtained with the same preparation method as that of Carrier 1, except that Mn—Mg ferrite particle (volume average particle diameter: 25 μm) is used instead of Mn—Mg ferrite particle (volume average particle diameter: 35 μm); the amount of cyclohexyl methacrylate/methyl methacrylate copolymer is changed from 3 parts to 5 parts; and carbon black is not used.

Preparation of Carrier 6

Carrier 6 is obtained with the same preparation method as that of Carrier 1, except that Mn—Mg ferrite particle (volume average particle diameter: 25 μm) is used instead of Mn—Mg ferrite particle (volume average particle diameter: 35 μm); the amount of cyclohexyl methacrylate/methyl methacrylate copolymer is changed from 3 parts to 1 part; and the amount of carbon black is changed from 0.3 part to 10 parts.

Preparation of Carrier 7

Carrier 7 is obtained with the same preparation method as that of Carrier 1, except that Mn—Mg ferrite particle (volume average particle diameter: 25 μm) is used instead of Mn—Mg ferrite particle (volume average particle diameter: 35 μm); and the amount of carbon black is changed from 0.3 part to 0.05 part.

The configurations of the prepared carriers are shown in Table 1.

TABLE 1

| | Core Particles | Resin Coating Layer | |
|---|---|---|---|
| Carrier No. | Mn-Mg Ferrite Particles Volume Average Particle Diameter (μm) | Carbon Black (Part(s) by Weight) | Copolymer (Part(s) by Weight) |
| Carrier 1 | 35 | 0.3 | 3 |
| Carrier 2 | 25 | 0.3 | 3 |
| Carrier 3 | 25 | None | 3 |
| Carrier 4 | 25 | 10 | 3 |
| Carrier 5 | 25 | None | 5 |
| Carrier 6 | 25 | 10 | 1 |
| Carrier 7 | 25 | 0.05 | 3 |

Preparation of Toner

Colorant Particle Dispersion

Carbon black: 50 parts

Anionic surfactant: 5 parts

Ion exchange water: 200 parts

The above-described components are mixed, are dispersed with ULTRA TURRAX (manufactured by IKA) for five minutes, and are further dispersed in an ultrasonic bath for ten minutes. As a result, Black colorant particle dispersion K having a solid content of 21% is obtained.

Yellow colorant particle dispersion Y, Magenta colorant particle dispersion M, and Cyan colorant particle dispersion C are obtained with the same preparation method as that of Black colorant particle dispersion K, except that a yellow pigment (C.I. Pigment Yellow 180; manufactured by Clariant Japan K.K.), a magenta pigment (C.I. Pigment Red 122; manufactured by DIC Corporation), and a cyan pigment (copper phthalocyanine C.I. Pigment Blue 15:3; manufactured by Dainichiseika Color & Chemicals Mfg. Co., Ltd.) are used instead of carbon black, respectively.

Release Agent Particle Dispersion 1

Paraffin wax (HNP-9 manufactured by Nippon Seiro Co. Ltd.): 19 parts

Anionic surfactant (NEOGEN SC, manufactured by Daiichi Kogyo Seiyaku Co. Ltd.): 1 part Ion exchange water: 80 parts The above-described components are mixed in a heat-resistant container, are heated to 90° C., and are stirred for 30 minutes. Next, the molten solution is caused to flow from the bottom of the container to a Gaulin homogenizer, and a circulation operation corresponding to three passes is performed under a pressure condition of 5 MPa. Next, a circulation operation corresponding to three passes is further performed under an increased pressure of 35 MPa. An emulsion obtained as above is cooled to 40° C. or lower in the heat-resistant container. As a result, Release agent particle dispersion 1 is obtained.

Resin Particle Dispersion 1

Oil Layer

Styrene (manufactured by Wako Pure Chemical Industries Ltd.): 30 parts

N-butyl acrylate (manufactured by Wako Pure Chemical Industries Ltd.): 10 parts

β-carboxyethyl acrylate (manufactured by Solvay): 1.3 parts

Dodecanethiol (manufactured by Wako Pure Chemical Industries Ltd.): 0.4 part

Water Layer 1

Ion exchange water: 17 parts

Anionic surfactant (DAWFAX manufactured by The Dow Chemical Company): 0.4 part

Water Layer 2

Ion exchange water: 40 parts

Anionic surfactant (DAWFAX manufactured by The Dow Chemical Company): 0.05 part

Ammonium peroxodisulfate (manufactured by Wako Pure Chemical Industries Ltd.): 0.4 part The above-described components of the oil layer and the above-described components of the water layer 1 are put into a flask, followed by stirring and mixing. As a result, a monomer emulsion dispersion is obtained.

The above-described components of the water layer 2 are put into a reaction container, the atmosphere in the container is sufficiently substituted with nitrogen, and the reaction container is heated in an oil path under stirring until the internal temperature of the reaction system reaches 75° C.

Further, the monomer emulsion dispersion is slowly added dropwise to the inside of the reaction container over three hours, followed by emulsion polymerization. After the completion of the dropwise addition, the polymerization is continued at 75° C. After three hours, the polymerization is finished.

The volume average particle diameter D50*v* of the obtained resin particles is 250 nm when measured using a laser diffraction particle diameter distribution analyzer LA-700 (manufactured by Horiba Ltd.).

The glass transition temperature of the resin is 52° C. when measured using a differential scanning calorimeter (DSC-50, manufactured by Shimadzu Corporation) at a temperature increase rate of 10° C./min.

The number average molecular weight (in terms of polystyrene) is 13,000 when measured using a molecular weight measuring device (HLC-8020, manufactured by Tosoh Corporation) and THF (tetrahydrofuran) as a solvent.

As a result, Resin particle dispersion 1 having a volume average particle diameter of 250 nm, a solid content of 42%, a glass transition temperature of 52° C., and a number average molecular weight Mn of 13,000 is obtained.

Preparation of Toner Particles

Resin particle dispersion 1: 150 parts

Colorant particle dispersion K: 30 parts

Release agent particle dispersion 1: 40 parts

Polyaluminum chloride: 0.4 part

The above-described components are sufficiently mixed and dispersed in a stainless steel flask using ULTRA TURRAX (manufactured by IKA). Next, the flask is heated to 48° C. in a heating oil bath under stirring. After the flask is held at 48° C. for 80 minutes, 70 parts of Resin particle dispersion 1 is slowly added thereto.

Next, the pH of the system is adjusted to 6.0 using an aqueous sodium hydroxide solution having a concentration of 0.5 mol/L, the stainless steel flask is sealed, and a stirring shaft is sealed with a magnetic force. The flask is heated to 97° C. under stirring and is held at this temperature for three hours. After the completion of the reaction, the flask is cooled at a temperature decrease rate of 1° C./min, followed by filtration, sufficient washing with ion exchange water, and solid-liquid separation by Nutsche suction filtration. The solid is redispersed in 3-liter of ion exchange water at 40° C., followed by stirring and washing at 300 rpm for 15 minutes.

This washing operation is repeated 5 times. When the pH of the filtrate is 6.54, and the electrical conductance is 6.5 μS/cm, solid-liquid separation is performed by Nutsche suction filtration with No. 5A filter paper. Next, the solid is dried in a vacuum for 12 hours. As a result, Toner particles K are obtained.

The volume average particle diameter of Toner particles K is 6.2 μm when measured using COULTER MULTISIZER II (manufactured by Beckman Coulter Co., Ltd.) and an aperture having an aperture size of 50 μm, and the volume average particle diameter distribution index GSDv thereof is 1.20.

The shape factor SF1 of the particles is 135 when the shape thereof is observed using an image analyzer LUZEX (manufactured by Nireco Corporation).

In addition, the glass transition temperature of Toner particles K is 52° C.

External Addition of External Additive

Further, silica ($SiO_2$) particles having an average primary particle diameter of 40 nm, which are surface-treated with a hydrophobizing agent of hexamethyldisilazane (HMDS), and metatitanic acid compound particles having an average primary particle diameter of 20 nm, which are a reaction product of metatitanic acid and isobutyl trimethoxy silane, are added to Toner particles K such that a coverage ratio of the surfaces of Toner particles K is 40%. The mixture is mixed using a HENSCHEL MIXER. As a result, Black toner K is prepared.

Yellow toner Y, Magenta toner M, and Cyan toner C are prepared with the same preparation method as that of Black toner K, except that Yellow colorant particle dispersion Y, Magenta colorant particle dispersion M, and Cyan colorant particle dispersion C are used instead of Black colorant particle dispersion K, respectively.

Preparation of Developer 100 parts of Carrier 1 obtained as above and 10 parts of Black toner K are stirred using a V-blender at 40 rpm for 20 minutes and are sieved through a sieve having a pore size of 125 μm. As a result, Black developer K1 is obtained.

In addition, Black developers K2 to K7 are obtained with the same preparation method as that of Black developer K1, except that Carriers 2 to 7 are used instead of Carrier 1, respectively.

Yellow developers Y7 and Y3, Cyan developers C7 and C3, and Magenta developers M7 and M3 are obtained with the same preparation method as that of black developer K1, except that carriers and toners are used as shown in Table 2 instead of Carrier 1 and Toner K.

The configurations of the prepared developers are shown in Table 2.

TABLE 2

| Kind | Developer No. | Carrier No. | Toner No. |
|---|---|---|---|
| Developer (Black) | Developer K1 | Carrier 1 | Toner K |
| | Developer K2 | Carrier 2 | Toner K |
| | Developer K3 | Carrier 3 | Toner K |
| | Developer K4 | Carrier 4 | Toner K |
| | Developer K5 | Carrier 5 | Toner K |
| | Developer K6 | Carrier 6 | Toner K |
| | Developer K7 | Carrier 7 | Toner K |
| Developer (Yellow) | Developer Y7 | Carrier 7 | Toner Y |
| | Developer Y3 | Carrier 3 | Toner Y |
| Developer (Cyan) | Developer C7 | Carrier 7 | Toner C |
| | Developer C3 | Carrier 3 | Toner C |
| Developer (Magenta) | Developer M7 | Carrier 7 | Toner M |
| | Developer M3 | Carrier 3 | Toner M |

Examples 1 to 4 and Comparative Examples 1 to 3

Images are printed using a modified machine of DOCUCENTRE COLOR 400 (manufactured by Fuji Xerox Co., Ltd.) under the following conditions. This modified machine is an intermediate transfer type image forming apparatus in which a toner image, which is transferred to a surface of an intermediate transfer member, is secondarily transferred to a surface of a recording medium. A first unit is provided on the most downstream side in a traveling direction of the intermediate transfer member, and three second units are provided on an upstream side of the first unit in the traveling direction of the intermediate transfer member.

Developers shown in Tables 3 and 4 are used as a first developer which is filled in a developing device of the first unit of the modified machine and a second developer which is filled in a developing device of the second unit of the modified machine. Using this modified machine, images are printed on A4-size plain paper (C2 paper, manufactured by Fuji Xerox Co., Ltd.) in the following procedure in an environment of 30° C. and 80% RH. First, on Day 1, 10,000 images having a rectangular patch with an image density 1% are continuously printed. Next, in an initial operation of Day 2, an image of The Imaging Society of Japan Test Chart No. 5 is printed, and then 10,000 images having a rectangular patch with an image density 1% are continuously printed. The image printing procedure of Day 2 is repeated every day. The number of images having a rectangular patch with an image density 1% which have been printed until Day 10 is 100,000. In an initial operation of the next day, an image of The Imaging Society of Japan Test Chart No. 5 is printed, and the evaluation of this image and the evaluation of carrier scattering and white void are performed. In the evaluations, Grade C or higher grade is set as tolerance level.

Next, images are printed on A4-size plain paper (C2 paper, manufactured by Fuji Xerox Co., Ltd.) in the following procedure in an environment of 10° C. and 10% RH. First, on Day 11, 10,000 images having a rectangular patch with an image density 15% are continuously printed. Next, in an initial operation of Day 12, an image of The Imaging Society of Japan Test Chart No. 5 is printed, and then 10,000 images having a rectangular patch with an image density 15% are continuously printed. The image printing procedure of Day 12 is repeated every day. The number of images having a rectangular patch with an image density 15% which have been printed until Day 20 is 100,000. Next, images having a 2 cm×2 cm rectangular patch with an image density of 100% and having a 3 cm×3 cm rectangular patch with an image density of 15% around the above rectangle are printed to evaluate a decrease in density and image deletion. In the evaluations, Grade C or higher grade is set as tolerance level.

Further, regarding each carrier of each developer before and after the test, resistance values are measured using the above-described method.

The results are shown in Tables 3 and 4.

Evaluation of Fogging

A: Fogging is not observed on the image, and there is no problem in image quality B: Toner scattering is observed in the machine, but there is no problem in image quality C: A small amount of fogging is observed on the image D: Fogging is clearly observed on the image Evaluation of Carrier Scattering and White Void A: Carrier scattering is not observed on the photoreceptor, and there is no problem in image quality. White void is not observed on the image, and there is no problem in image quality B: A small amount of carrier scattering is observed on the photoreceptor, but there is no problem in image quality C: Carrier scattering is observed on the photoreceptor, and a small amount of white void is observed on the image D: Carrier scattering is observed on the photoreceptor. White void is clearly observed on the image Evaluation of Decrease in Density and Image Deletion A: A decrease in density and image deletion are not observed on the image B: A small decrease in density is observed on the image, but image deletion is not observed.

C: A small decrease in density is observed on the image, and a small amount of image deletion is observed D: A decrease in density is clearly observed on the image, and image deletion is clearly observed

TABLE 3

| | First Developer | Second Developer | Resistance Values (Ω) of Carriers Before Test: First Carrier | Resistance Values (Ω) of Carriers Before Test: Second Carrier | Ratio of Resistance Values of Carriers (First Carrier/Second Carrier): Before Test | Ratio of Resistance Values of Carriers (First Carrier/Second Carrier): After Test | Evaluation of Fogging | Evaluation of White Void and Carrier Scattering | Evaluation of Decrease in Density and Image Deletion |
|---|---|---|---|---|---|---|---|---|---|
| Example 1 | Developer K1 | Developer Y7 | $6.1 \times 10^{9}$ | $9.5 \times 10^{11}$ | $6.4 \times 10^{-3}$ | $2.3 \times 10^{-3}$ | A | A | A |
| | | Developer M7 | | $9.5 \times 10^{11}$ | $6.4 \times 10^{-3}$ | $2.3 \times 10^{-3}$ | | | |
| | | Developer C7 | | $9.5 \times 10^{11}$ | $6.4 \times 10^{-3}$ | $2.3 \times 10^{-3}$ | | | |
| Example 2 | Developer K2 | Developer Y7 | $5.5 \times 10^{9}$ | $9.5 \times 10^{11}$ | $5.8 \times 10^{-3}$ | $2.0 \times 10^{-3}$ | A | A | A |
| | | Developer M7 | | $9.5 \times 10^{11}$ | $5.8 \times 10^{-3}$ | $2.0 \times 10^{-3}$ | | | |
| | | Developer C7 | | $9.5 \times 10^{11}$ | $5.8 \times 10^{-3}$ | $2.0 \times 10^{-3}$ | | | |

TABLE 3-continued

| | First Developer | Second Developer | Resistance Values (Ω) of Carriers Before Test: First Carrier | Resistance Values (Ω) of Carriers Before Test: Second Carrier | Ratio of Resistance Values of Carriers (First Carrier/Second Carrier): Before Test | Ratio of Resistance Values of Carriers (First Carrier/Second Carrier): After Test | Evaluation of Fogging | Evaluation of White Void and Carrier Scattering | Evaluation of Decrease in Density and Image Deletion |
|---|---|---|---|---|---|---|---|---|---|
| Example 3 | Developer K3 | Developer Y7 | $9.2 \times 10^{11}$ | $9.5 \times 10^{11}$ | $9.7 \times 10^{-1}$ | $4.4 \times 10^{-1}$ | B | B | A |
| | | Developer M7 | | $9.5 \times 10^{11}$ | $9.7 \times 10^{-1}$ | $4.4 \times 10^{-1}$ | | | |
| | | Developer C7 | | $9.5 \times 10^{11}$ | $9.7 \times 10^{-1}$ | $4.4 \times 10^{-1}$ | | | |
| Example 4 | Developer K5 | Developer Y7 | $3.8 \times 10^{7}$ | $9.5 \times 10^{11}$ | $4.0 \times 10^{-5}$ | $2.3 \times 10^{-4}$ | B | A | B |
| | | Developer M7 | | $9.5 \times 10^{11}$ | $4.0 \times 10^{-5}$ | $2.3 \times 10^{-4}$ | | | |
| | | Developer C7 | | $9.5 \times 10^{11}$ | $4.0 \times 10^{-5}$ | $2.3 \times 10^{-4}$ | | | |

TABLE 4

| | First Developer | Second Developer | Resistance Values (Ω) of Carriers Before Test: First Carrier | Resistance Values (Ω) of Carriers Before Test: Second Carrier | Ratio of Resistance Values of Carriers (First Carrier/Second Carrier): Before Test | Ratio of Resistance Values of Carriers (First Carrier/Second Carrier): After Test | Evaluation of Fogging | Evaluation of White Void and Carrier Scattering | Evaluation of Decrease in Density and Image Deletion |
|---|---|---|---|---|---|---|---|---|---|
| Comparative Example 1 | Developer K5 | Developer Y7 | $4.7 \times 10^{15}$ | $9.5 \times 10^{11}$ | $4.9 \times 10^{3}$ | $8.2 \times 10^{3}$ | D | B | D |
| | | Developer M7 | | $9.5 \times 10^{11}$ | $4.9 \times 10^{3}$ | $8.2 \times 10^{3}$ | | | |
| | | Developer C7 | | $9.5 \times 10^{11}$ | $4.9 \times 10^{3}$ | $8.2 \times 10^{3}$ | | | |
| Comparative Example 2 | Developer K6 | Developer Y7 | $7.2 \times 10^{5}$ | $9.5 \times 10^{11}$ | $7.6 \times 10^{-7}$ | $2.9 \times 10^{-6}$ | C | D | A |
| | | Developer M7 | | $9.5 \times 10^{11}$ | $7.6 \times 10^{-7}$ | $2.9 \times 10^{-6}$ | | | |
| | | Developer C7 | | $9.5 \times 10^{11}$ | $7.6 \times 10^{-7}$ | $2.9 \times 10^{-6}$ | | | |
| Comparative Example 3 | Developer K7 | Developer Y3 | $9.5 \times 10^{11}$ | $9.2 \times 10^{11}$ | $1.04 \times 10^{0}$ | $1.3 \times 10^{-2}$ | D | C | A |
| | | Developer M3 | | $9.2 \times 10^{11}$ | $1.04 \times 10^{0}$ | $1.3 \times 10^{-2}$ | | | |
| | | Developer C3 | | $9.2 \times 10^{11}$ | $1.04 \times 10^{0}$ | $1.3 \times 10^{-2}$ | | | |

It may be seen from the above results that, in Examples, fogging, white void, and carrier scattering are prevented as compared to Comparative Examples. In addition, it may also be seen that, in Examples, there is a small variation in the ratio of the resistance values of the first carrier to the resistance value of the second carrier between before and after the test, as compared to Comparative Examples.

It may be seen from these results that a difference in the variation of the resistance value between the respective carriers is suppressed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a first image forming unit that includes a first image holding member and a first developing unit that develops an electrostatic charge image formed on a surface of the first image holding member; and a second image forming unit that includes a second image holding member and a second developing unit that develops an electrostatic charge image formed on a surface of the second image holding member, wherein the first image forming unit is arranged on a downstream side of the second image forming unit in a traveling direction of a transfer medium, the first developing unit contains a first developer containing a first toner and a first carrier, the second developing unit contains a second developer containing a second toner and a second carrier, wherein a ratio of a resistance value of the first carrier to a resistance value of the second carrier is within a range of from $4.0\times10^{-5}$ to $9.7\times10^{-1}$.

2. The image forming apparatus according to claim 1, comprising:

a plurality of the second image forming units.

3. The image forming apparatus according to claim 1, wherein the first developer is a black developer.

4. The image forming apparatus according to claim 1, wherein the resistance value of the first carrier and the resistance value of the second carrier are within a range of from $1\times10^{6}$ Ω·cm to $1\times10^{14}$ Ω·cm.

5. The image forming apparatus according to claim 1, wherein the resistance value of the first carrier and the resistance value of the second carrier are within a range of from $1\times10^{7}$ Ω·cm to $1\times10^{13}$ Ω·cm.

6. The image forming apparatus according to claim 1, wherein a coating resin of the first carrier and a coating resin of the second carrier are a resin having a cycloalkyl group.

7. An electrostatic charge image developing carrier set comprising:

a first carrier; and a second carrier, wherein a first image forming unit including the first carrier is arranged on a downstream side of a second image forming unit including the second carrier in a traveling direction of a transfer medium, and a ratio of a resistance value of the first carrier to a resistance value of the second carrier is within a range of from $4.0\times10^{-5}$ to $9.7\times10^{-1}$.

8. The electrostatic charge image developing carrier set according to claim 7, wherein the first carrier is used in a black developer.

9. The electrostatic charge image developing carrier set according to claim 7, wherein the resistance value of the first carrier and the resistance value of the second carrier are within a range of from $1\times10^{6}$ Ω·cm to $1\times10^{14}$ Ω·cm.

10. The electrostatic charge image developing carrier set according to claim 7, wherein a coating resin of the first carrier and a coating resin of the second carrier are a resin having a cycloalkyl group.

11. A process cartridge set that is detachable from an image forming apparatus, the process cartridge comprising:

a first process cartridge that includes a first image holding member and a first developing unit that develops an electrostatic charge image formed on a surface of the first image holding member; and a second process cartridge that includes a second image holding member and a second developing unit that develops an electrostatic charge image formed on a surface of the second image holding member, wherein the first process cartridge is arranged on a downstream side of the second process cartridge in a traveling direction of a transfer medium, the first developing unit contains a first developer containing a first toner and a first carrier, the second developing unit contains a second developer containing a second toner and a second carrier, and a ratio of a resistance value of the first carrier to a resistance value of the second carrier is within a range of from $4.0\times10^{-5}$ to $9.7\times10^{-1}$.

12. The process cartridge set according to claim 11, wherein the first carrier is used in a black developer.

13. The process cartridge set according to claim 11, wherein the resistance value of the first carrier and the resistance value of the second carrier are within a range of from $1\times10^{6}$ Ω·cm to $1\times10^{14}$ Ω·cm.

14. The process cartridge set according to claim 11, wherein a coating resin of the first carrier and a coating resin of the second carrier are a resin having a cycloalkyl group.

* * * * *